US007128262B2

(12) United States Patent
Rieder et al.

(10) Patent No.: US 7,128,262 B2
(45) Date of Patent: Oct. 31, 2006

(54) AUTOMATIC FEE CHARGING SYSTEM

(75) Inventors: Helmut Rieder, Graz (AT); Raimund Pammer, Graz (AT)

(73) Assignee: Efkon AG, Graz (AT)

( * ) Notice: Subject to any disclaimer, the term of this patent is extended or adjusted under 35 U.S.C. 154(b) by 54 days.

(21) Appl. No.: 10/203,313

(22) PCT Filed: Feb. 8, 2001

(86) PCT No.: PCT/AT01/00030

§ 371 (c)(1),
(2), (4) Date: Aug. 6, 2002

(87) PCT Pub. No.: WO01/59711

PCT Pub. Date: Aug. 16, 2001

(65) Prior Publication Data

US 2003/0011494 A1 Jan. 16, 2003

(30) Foreign Application Priority Data

Feb. 8, 2000 (AT) ..... A 199/2000

(51) Int. Cl.
*G07B 15/02* (2006.01)

(52) U.S. Cl. ..... 235/384

(58) Field of Classification Search ..... 235/384; 705/13

See application file for complete search history.

(56) References Cited

U.S. PATENT DOCUMENTS 5,101,200 A 3/1992 Swett
5,289,183 A 2/1994 Kowal et al.
5,347,274 A 9/1994 Hassett
5,347,280 A * 9/1994 Schuermann ..... 342/42
5,440,109 A * 8/1995 Hering et al. ..... 235/384
5,490,079 A 2/1996 Lindsley et al.
5,857,152 A 1/1999 Everett
6,394,343 B1 * 5/2002 Berg et al. ..... 235/379

FOREIGN PATENT DOCUMENTS

| | | |
|---|---|---|
| EP | 0 780 801 | 6/1997 |
| FR | 2 609 812 | 7/1988 |
| KR | 100-230581 | 8/1999 |
| WO | WO 99/03218 | 1/1999 |
| WO | WO 99/25087 | 5/1999 |
| WO | WO 99/33027 | 7/1999 |
| WO | WO 99/48052 | 9/1999 |
| WO | WO 99/66455 | 12/1999 |
| WO | WO 00/45343 | 8/2000 |

OTHER PUBLICATIONS

Translation of KIPO Office Action.

* cited by examiner

*Primary Examiner*—Thien M. Le
*Assistant Examiner*—Lisa M. Caputo
(74) *Attorney, Agent, or Firm*—Collard & Roe, P.C.

(57) ABSTRACT

A system for automatically charging fees when predetermined positions are passed, comprising a communication device (4) for dedicated short range communication (DSRC) that is intended for an at least temporarily stationary installation, and at least one mobile communication unit (7) for dedicated short range communication (DSRC); the DSRC communication device (4) provided to be stationarily installed is adapted for transmitting information identifying itself and thus, at least indirectly, its position of installation to the mobile DSRC communication unit (7).

22 Claims, 2 Drawing Sheets

FIG. 1
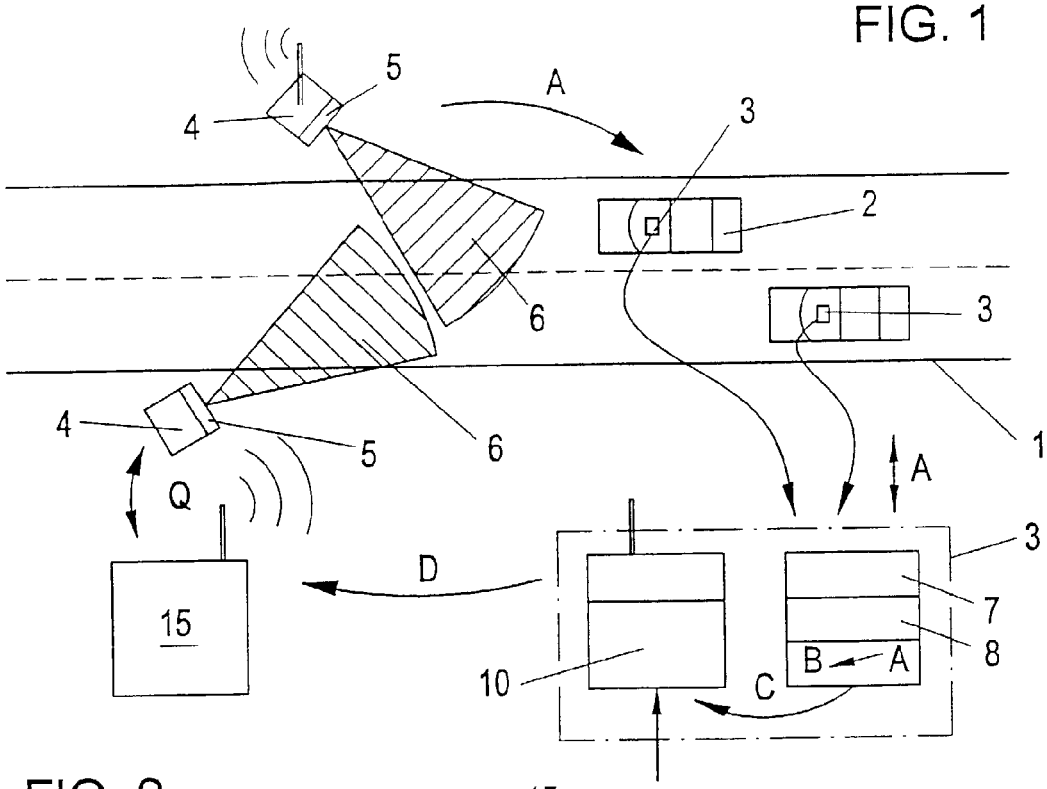
FIG. 2
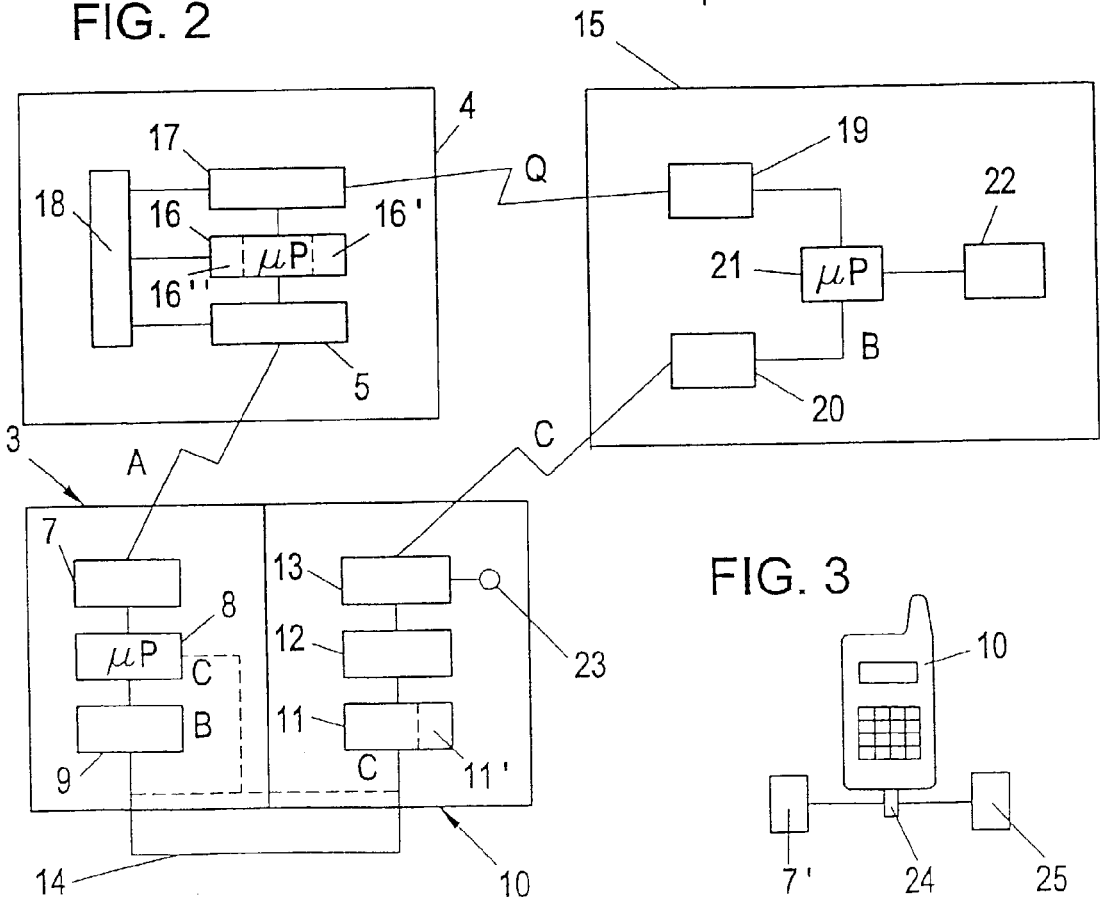
FIG. 3

AUTOMATIC FEE CHARGING SYSTEM

CROSS REFERENCE TO RELATED APPLICATIONS

Applicants claim priority under 35 U.S.C. §119 of Austrian Application No. A 199/2000 filed Feb. 8, 2000. Applicants also claim priority under 35 U.S.C. §365 of PCT/AT01/00030 filed Feb. 8, 2001. The international application under PCT article 21(2) was not published in English.

BACKGROUND OF THE INVENTION

1. Field of the Invention

The invention relates to a system for automatically charging fees when pre-determined positions are passed, e.g. for collecting road toll or parking fees, comprising a communication device for dedicated short range communication (DSRC) that is intended for an at least temporarily stationary installation, and at least one mobile communication unit for dedicated short range communication (DSRC).

2. Description of the Prior Art

Such a system is disclosed in WO 99/33027 A. In such a system, in particular for collecting tolls from motor vehicles, so-called "virtual" toll stations are used which enter into a bidirectional communication with vehicle-borne installations when the vehicles pass these stations. Information regarding the position of the vehicles is transmitted to the vehicle-borne device via a system such as GNSS (Global Navigation Satellite System), or GPS (Global Positioning System), respectively. The payment procedure is effected by linking the position information and the data stored in a device. The major disadvantage is that locating the vehicles is relatively imprecise and unreliable, and also the determination and the comparison with the virtual toll station is unsatisfactory; moreover, the devices required for this system are complex and expensive.

A quite similar system is described in WO 99/48052 A. This includes an identification of the vehicle-borne communication unit by means of, e.g., a smart card which is read out upon enquiry by the stationary toll station, thereby identifying the associated vehicle. The stationary toll station furthermore communicates with a central computer system so as to carry out the charging of the fees. However, this is rather complex as regards various identification and communication processes.

Moreover, from WO 99/66455 A a road-borne control for a toll device installed in a vehicle is known. For position determination, a GPS device is provided so that the road-borne control means can be recognized, or identified, respectively, by means of GPS at its respective site of installation.

A special dedicated short range communication method, in particular using microwaves, for communicating with a vehicle-borne unit (so-called "OBU"—On Board Unit) is disclosed in WO 99/25087 A, wherein a step-wise adjustment of the degree of modulation is effected in the modulation of a carrier wave. This, too, is a bidirectional communication between stationary installations (beacons) and vehicle-borne units, wherein nothing is said on obtaining an information regarding the position.

SUMMARY OF THE INVENTION

It is an object of the invention to provide a system of the initially defined type which is characterized by a simple configuration and nevertheless, reliable functioning, and which thus is inexpensive and also simple to instal.

The inventive system of the initially defined type is characterized in that the DSRC communication device provided to be stationarily installed is adapted for transmitting information identifying itself and thus, at least indirectly, its position of installation, to the mobile DSRC communication unit.

In the present system, complex self-locating devices, such as GPS, or GNSS, respectively, and the complex programs required therefor are not needed, since the communication devices (called "stationary DSRC communication device" in short hereinafter for the sake of simplicity) provided for the at least temporary stationary installaltion transmit appropriate identifying, and thus locating, information; this information allows for an unambiguous identification of these stationary communication devices and thus, at least indirectly, their position. The stationary communication devices may work autonomously, or asynchronously, respectively, i.e. they need not be linked in a network, and preferably they work in a transmission operation only, so that unidirectional DSRC communication will suffice for a position determination or locating procedure. The present system is excellently suited to be employed both in open and in closed tolling systems, or also in parking systems, wherein the charging of fees proper, the payment procedure, as the system operator wishes, may be carried out via the most varying means, such as via cards and card reading machines at gas stations or other payment stations. If the stationary communication devices merely have a transmitter function and thus need not receive any data from the mobile communication units, e.g. in vehicles, they can be constructed in a very simple and thus low-cost manner. Also the omission of memory functions for sensitive data, such as data relating to amounts of fees or vehicle data, contributes to this.

Depending on the individual tolling system, the fee determination will be effected when a stationary communication device is passed once, or after two such communication devices have been passed (driving in and out). The corresponding techniques or programs therefor are conventional per se and need not be further explained here. If tolls or the like are collected, it may be suitable if the stationary DSRC communication device additionally transmits position information regarding its site of installation together with the information clearly identifying itself. Depending on the system of collecting fees, the position information may, e.g., consist in indicating numbers or the like designating the respective stationary communication device, wherein during the fee calculation the respective positions can be concluded from these numbers and the amount of fees can be determined accordingly. Particularly in the case of collecting parking fees when virtual parking place "barriers" are passed which are formed by stationary DSRC communication devices, it is furthermore advantageously provided that the DSRC communication device contains a clock (e.g. in a processor) and transmits information indicating the respective point of time of transmission with the information clearly identifying itself. Thereby the parking times can be calculated by registering the points of time of driving in and driving out.

To allow for a calculation of the respective fee directly via the mobile DSRC communication unit, it is furthermore advantageous if the stationary DSRC communication device transmits information regarding fees, e.g. fixed fee data or fee determining regulations, taken from a memory, together with the information identifying itself. The respective amounts of fees can be directly transmitted, or calculating regulations, such as data on the basis of which the fees for the respective case can be taken from tables in the mobile DSRC communication unit, can be transmitted. In this connection it is, therefore, suitable if the mobile DSRC communication unit has an associated fee-calculating unit—e.g. realized by a processor—for determining the respective fee on the basis of a fee information transmitted by the stationary DSRC communication device. The determined fee may then be entered on a value account, e.g. by means of a booking unit, in particular within the mobile, or vehicle-borne, respectively, unit (also called on board unit, OBU), whereby the value account will change its value. A system per se already known e.g. in connection with cellular phones using value cards (SIM cards, or so-called "smart cards") may be used, yet it is also conceivable to deduct the fee from an external account. In case of an additional mobile radio device, this deduction may also occur immeditately over the latter. This will also advantageously be possible if the fee is deducted via a subscriber's meter of a telephone account.

To protect the system from fraudulent access, it is also advantageous if the mobile DSRC communication unit and/or the stationary DSRC communication device has an associated cryptographic unit. This cryptographic unit may provide the respective transmitted information with a signature, e.g. If the code or the signature, respectively, changes continually, it will be practically impossible for unauthorized persons to get access to the received information. Not even the vehicle-borne unit can perform a decoding, and only at the payment procedure proper, e.g. at a payment beacon or at a smart card machine, a hyper-signature calculated from the various locating signatures will be checked, and only the system operator can determine the genuineness and integrity of the code; subsequently, the actual amount due will be calculated and, e.g., be deducted from the smart card, wherein it is possible to store time and signature in a log-memory on the smart card, or in the mobile unit (OBU), respectively. The payment procedure proper may occur in various ways, such as when re-charging the smart card on a machine or at an appropriately equipped cash desk terminal, when re-charging the smart card via a cellular telephone system (GSM, UMTS etc.), or when re-charging the smart cards via a DSRC communication system. The cryptographic unit may, in principle, also encode the respective information transmitted.

As already results from the preceding discussion, it is suitably provided that the mobile DSRC communication unit has an associated memory for storing the information transmitted by the stationary DSRC communication device. For a possible direct charging of fees via the stationary devices it has also proven to be suitable if the mobile DSRC communication unit is equipped with a DSRC transmitter, and the DSRC communication device is equipped with a DSRC receiver, and the DSCR communication device has an associated fee charging unit.

Furthermore, it is advantageous if the mobile DSRC communication unit has an associated mobile radio device. Here it is conceivable and often suitable with a view to a high flexibility of the system, if the mobile DSRC communication unit is in connection with the mobile radio device via at least one monodirectional, preferably bidirectional, DSRC communication equipment. On the other hand, it is advantageous for obtaining a compact OBU, if the mobile DSRC communication unit is directly connected in one unit with the mobile radio device, preferably shares one housing therewith.

For checking purposes and for determining statistics, it may, furthermore, also be suitable if the mobile radio device is adapted for transmitting information to a central data processing machine. Optionally, this radio transmission may also be used for the charging of fees via the central data processing machine.

To provide further functions, it is advantageously provided that the mobile radio device is a cellular phone with a hands-free talking device. The electric point of connection (e.g. a plug) between the mobile radio device, i.e. the cellular phone, and the hands-free talking device may be adapted such that the mobile DSRC communication unit can be connected at this point of connection. This communication connection may be maintained when the connection for the hands-free talking device is not in use.

Particularly for enabling a simple updating of the information at the respective stationary DSRC communication devices, it is, moreover, advantageous if the stationary DSRC communication device has an associated mobile radio device.

The stationary DSRC communication devices may be equipped with separate batteries, and in principle also connections to the power mains may be provided with appropriate supply units. For an autonomous energy supply, the respective stationary communication device preferably is provided with a solar energy device as a power supply. The solar energy in this instance is supplied to a chargeable battery.

For a faultless functioning it has proven particularly suitable if the DSRC communication device or the DSRC communication unit is designed with an infrared transmitting, or receiving device, respectively.

It is also advantageous if the DSRC communication device is adapted to carry out a self-test, e.g. for checking the power supply, or the functioning of the communication device, respectively. In case a malfunction is determined at a self-test, optionally a malfunction report can be delivered to a central monitoring site, if a radio device comprising an emergency power supply is provided.

BRIEF DESCRIPTION OF THE DRAWING

In the following, the invention will be explained in more detail by way of preferred exemplary embodiments illustrated in the drawings to which, however, it shall not be restricted. In detail, in the drawings FIG. 1 schematically shows the present system in an embodiment for collecting road tolls, wherein a toll road is illustrated in a schematic top view, showing two vehicles, as well as the system components provided at a "virtual toll-collecting site", and, moreover, a vehicle-borne unit is separately illustrated;

FIG. 2 shows a schematic block diagram of the present system;

FIG. 3 schematically illustrates a cellular phone forming part of the vehicle-borne installation and including a hands-free talking device and a DSRC communication unit.

DETAILED DESCRIPTION OF THE PREFERRED

Figure 4:
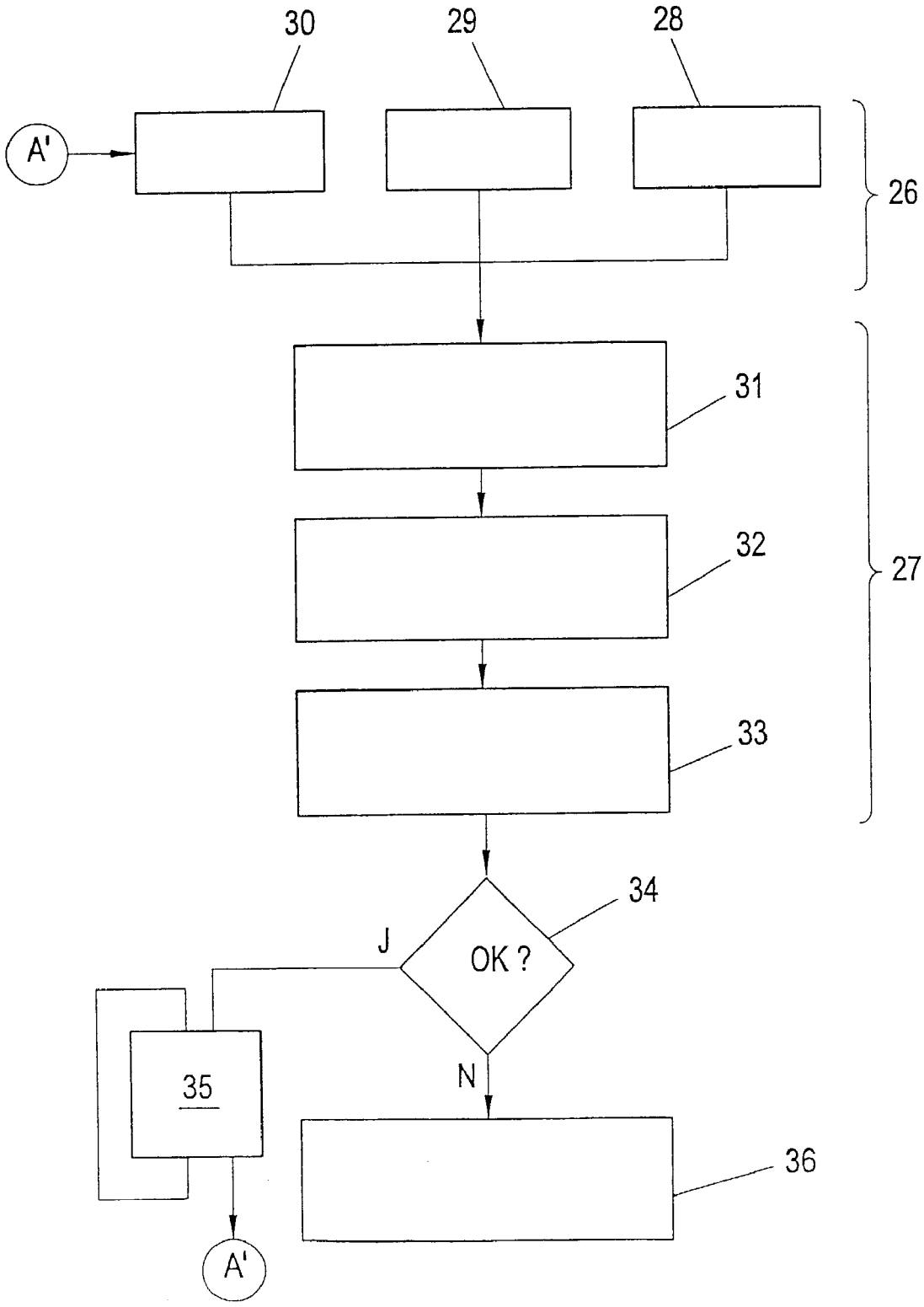
FIG. 4 shows a flow chart illustrating the carrying out of a self-test for the stationary communication device.

In FIG. 1, a road toll system is schematically shown as the preferred exemplary embodiment of the system of the invention, wherein a toll road 1 is illustrated on which vehicles 2 are to be sensed for collecting a toll. For this purpose, the present fee-charging system comprises vehicle-borne units 3, with such a vehicle-borne unit 3 being separately shown in a block illustrated with broken lines for a better illustration; moreover, the system includes at least temporarily stationarily installed locating beacons 4 equipped with DSRC communication devices. These beacons 4 may be stationarily mounted, such as on columns anchored in the ground, yet also mobile beacons may be used which can be transported to the toll road as required and temporarily set up there in a stationary manner.

The (temporarily) stationary DSRC communication devices, termed stationary beacons 4 in short hereinafter for the sake of simplicity, preferably are equipped with infrared transmission devices 5 which, with their emitted infrared signals (information A), cover a sector-shaped locating range 6 extending over only a few meters.

Instead of the infrared transmission devices 5, of course, also conventional microwave or radio transmission devices as such are conceivable providing a communication merely in a close range. With a view to the fact that infrared radiation is incoherent and thus will not result in an extinction by a superposition of signals, in the present case the infrared transmission is preferred over the other possible modes of transmission.

In corresponding manner, the vehicle-borne units 3 contain a (mobile) DSRC communication unit, in particular with a suitable infrared receiver, cf., e.g. also WO 99/03218 A, in which an example of a suitable IR receiver is shown, and this mobile DSRC communication unit is illustrated at 7 in FIG. 1.

In a minimum configuration, the system accordingly is equipped only with transmitting stationary DSRC transmission beacons 4 as well as with receiving mobile DSRC communication units 7, these mobile communication units 7 optionally having an associated fee calculation and booking unit 8, as is schematically shown in FIG. 1. This booking unit 8 may be realized by a processor in a per-se conventional manner. The mobile DSRC communication unit 7 may also be equipped with a cryptographic unit or an encoding unit not illustrated in detail in FIG. 1, yet cf. FIG. 2, where such a cryptographic unit is shown at 9. This cryptographic unit 9 serves, e.g., to provide the information or data to be transmitted or received, which are transmitted by the stationary beacon 4, with a continually changing signature so as to make the system safe from unauthorized access. In the vehicle-borne unit 3 (commonly termed OBU, On Board Unit) there is no decoding means, and decoding will occur only at the actual payment procedure, e.g. at a payment beacon or a conventionally designed smart card machine, where a "hyper-signature" calculated from the various locating "signatures" by the OBU will be checked and used as a basis for fee payment. Only the system operator with his corresponding devices will be capable of determining the authenticity and integrity of the encoded information.

For instance, the OBU 3 itself will determine the respective charge due, from the beacon locating data received and from data stored therein in a memory not illustrated in detail and associated to a microprocessor 8 and regarding the vehicle category etc., cf. the information flow denoted by B in FIGS. 1 and 2. Then this fee will be deducted from a value account provided in the OBU 3, wherein the value account may, e.g., be realized by a value card, i.e. a smart card or a SIM card, or by a chip.

In the preferred exemplary embodiment illustrated, a mobile radio device is additionally provided in the respective vehicle, as is illustrated at 10 in FIGS. 1 and 2. This mobile radio device 10 may be formed by a substantially conventional cellular phone (GSM, UMTS etc.), and it may be provided separately from the OBU 3 proper or combined into a unit therewith. Preferably, the OBU 3 and the mobile radio device 10 may even share one housing, wherein components usable by both, such as processors, may be used even though a separate processor 11 (with a memory 11') is shown for the mobile radio device 10 in FIGS. 1 and 2, which processor is connected to a SIM card unit 12. The radio transmission unit proper for transmitting and receiving is illustrated at 13 in FIG. 2.

If it is a separate unit, the mobile radio device 10 receives signals or information C supplied by the OBU 3, e.g. via a DSRC system or via a connecting line, as is schematically shown at 14 in FIG. 2. If these two units 3 and 10 share one housing, the connecting line 14 in the housing interior may be short, it may, e.g., be provided on a common printed circuit board. Above all, in that case also the processors 8 and 11 may be realized by one single processor.

As is, moreover, apparent from FIGS. 1 and 2, a central data processing machine 15 may be provided which is adapted to convey information Q to the stationary beacons 4, on the one hand, and to at least receive information D from the vehicle-borne units 3, on the other hand. In detail, the central data processing device 15 may transmit data or information Q provided with the appropriate address codes to the stationary beacons 4 so as to update data stored there, e.g. relating to position, tariff of charges, points of time etc. It may, moreover, be also provided that information, such as on the incident traffic (by counting the passing vehicles) is transmitted by the stationary beacons 4 to the central data processing machine 15.

On the other hand, the information flow D from the vehicle-borne units 3 to the central data processing device 15 may, e.g., contain data for checking the fees charged or actual information regarding the fees. The locating information A which is transmitted from the beacons 4 to the vehicles 2 or to the vehicle-borne units 3, contains data clearly identifying the respective beacon 4 so as to allow for an unambiguous locating or position determination of the vehicles 2.

To activate the respective communication device 5 (with the infrared transmitter), as is apparent in detail in FIG. 2, the stationary beacons 4 comprise a processor 16 (e.g. μP microprocessor) with an associated, merely schematically illustrated memory 16' which contains the respective identifying or position information. Processor 16 also activates a radio device 17 which carries out the transmission of the information Q to, and from, respectively, the central data processing device 15. Furthermore, the processor 16 contains a clock 16" so that also information indicating the respective time of transmission can be co-transmitted.

For an autonomous energy supply of the individual components of the stationary beacons 4, preferably a solar cell device 18 is provided to which an appropriately chargeable battery with a charging device (not illustrated) is associated in a conventional manner; such solar energy devices are sufficiently known, thus not requiring any further description thereof.

Although a solar power supply has just been mentioned, a conventional means may, of course, be provided just as well.

As is apparent, the beacons 4 are extremely simple in their structure, which is due to the fact that, as far as the communication with the vehicles 2 is concerned, they need only have a transmitter function, so that they need not receive any data from the vehicles 2. This also does away with the necessity of storing such sensitive date as amounts of fees and vehicle data, making things easier also in this respect. The infrared transmitting unit may be designed in a per-se conventional manner with infrared transmitting diodes and an optical focussing unit; processor 16 forms the control electronic including the memory 16', and the radio device 17 may, e.g., be a GSM transmitter/receiver for remote service and remote administration.

It is, as such, also conceivable to built up a bidirectional connection for the OBU 3 to the beacons 4, in which case the beacons 4 can be appropriately equipped so as to receive vehicle and fee data, respectively, and to transmit them to the central data processing device 15. In the preferred embodiment, however, the beacons 4 are merely equipped for transmission operation, as mentioned before, the continuous transmission of information clearly identifying the respective beacons 4 (information A) being considered as essential. The beacons 4 thus may operate completely autonomously and asynchronously, and due to the transmitted information A, they can each be identified for an unambiguous locating procedure so as to carry out the necessary calculation of fees.

If the stationary beacons 4 are to be associated to a parking area and parking fees are to be charged, information A may, as has been mentioned, also co-transmit information regarding the respective time of passage of the vehicle so as to enable a calculation of the duration of parking. Such time information may also be useful in tolling systems—e.g. for checking purposes—so that also there they are preferably co-transmitted.

Moreover, the transmitted information A may already contain a fee information, wherein, e.g., data are transmitted on the basis of which the respective fees are determined in the OBU 3 with the assistance of tables stored there, yet it is also possible to directly transmit the required amounts of fees; the latter may be particularly advantageously provided in open toll systems.

According to FIG. 2, the central data processing unit 15 comprises radio devices 19, 20 for the radio communication to the stationary beacons 4 or to the radio devices 13, respectively, of the OBUs 3. These radio units 19, 20 are connected to a processor 21, in particular a logfile processor unit, which has an associated memory 22 with a data base.

As has already been indicated, in the simplest case the standard OBU 3 may be designed without a mobile radio device 10, wherein it may be equipped with an infrared receiving unit and a smart card, or SIM-card unit, respectively. The OBU 3 may be battery-operated, and it may, e.g., be fastened by means of a clamp in the region of the interior rearview mirror in the vehicle on the window shield in the top middle part thereof. In this case, no cables to the electricity of the vehicle are required. All the sensitive data are encoded and stored on the smart card, and this smart card can be read or re-charged, respectively, via common cash desk terminals and money machines.

As an alternative thereto, it may also be provided that the entire OBU 3 is detached from the attachment on the windshield, and that a smart card chip contained therein in which the sensitive data are stored is recharged, or read, respectively, outside of the vehicle, via cash-desk terminals appropriately equipped with an infrared writing/reading head.

In the particularly preferred embodiment, a combination with a cellular phone (GSM-OBU) is provided, as explained before, and this combined OBU 3 preferably is supplied with power from the car battery. Here, too, preferably all sensitive data are stored encoded on a smart card chip, read-out or charging, respectively, of the same being possible via the cellular telephone network.

The mobile radio device 10 may be equipped with a hands-free talking device, cf. the hands-free talking device connection 23 in FIG. 2, as well as the diagram in FIG. 3 where a cellular phone 10 including a connecting plug 24 to a hands-free speaking device 25 is shown; to the connecting plug 24, at the same time the DSRC communication unit 7' is connected, wherein the fee-charging function may also be ensured with the hands-free speaking device 25 connected, by appropriate programming of processor 11.

A further possible modification consists in that the OBU 3 is temporarily removed from the vehicle 2 and transmits information from outside of the vehicle 2 to a special bidirectional DSRC equipment so as to carry out calculation of fees.

By an appropriate programming (with the program possibly being stored in memory 16'), the processor 16 of the stationary beacons 4 may also be adapted to periodically carry out a self-test, wherein, i.a., the power supply just as the functioning ability of the transmitting and receiving means proper can be tested; likewise, the memory 16' itself can be subjected to a test. In case of malfunction, the radio device 17—if still capable of functioning and equipped with an emergency power supply—may transmit a malfunction report to the central data processing device 15. Alternatively, the system may also be equipped such that the stationary beacons 4 periodically transmit a functional ability report, e.g. every 15 minutes, to the data processing device 15; if this report from the stationary beacon 4 does not arrive at the pre-determined time, this is recognized by the data processing device as a malfunction of the respective beacon 4 and reported to the monitoring personnel so that a checking and repair may occur on location.

In FIG. 4, the procedure of such a self-test of the stationary beacon 4 is illustrated. In FIG. 4, at 26 the triggering of the self-test is generally inidcated, while the execution-of the test is illustrated at 27. For triggering the test, a time-interval information derived from the clock in processor 16 may serve as trigger event, such as "daily 8 o'clock a.m." or "every 15 minutes", this triggering being illustrated at 28 in FIG. 4. At 29 it is furthermore shown that the self-test is triggered from the outside, e.g. by the central data processing device 15. Block 30 shall indicate quite generally that also other possible triggering modes are possible.

When carrying out the test, as indicated at 27 in FIG. 4, at first the voltage supply may be tested, cf. block 31 in FIG. 4. Then the transmitting unit proper (cf. pos. 5 in FIG. 2) will be tested, particularly as to which extent the infrared diodes of the transmitting unit are ready for operation (block 32). According to block 33, a test may then be carried out regarding the integrity of memory 16' and processor 16 etc. At 34 the decision is indicated in FIG. 2, whether the checked units are working (output J) or not (output N). If the result of the test is positive, it is passed on to a loop 35 and it is waited for the next triggering 26 to then again start the self-test at position A'. If a malfunction is found, a report will occur according block 36 to a central maintenance unit, e.g. the central data processing device 15 according to FIGS. 1 and 2.

The invention claimed is:

1. A system for automatically charging fees when predetermined positions are passed, comprising a stationarily installed infrared communication device, and at least one mobile infrared communication unit, wherein the infrared communication device is adapted for transmitting information identifying itself and, thus, its position of installation together with information regarding fees taken from a memory to the mobile infrared communication unit, and the mobile infrared communication unit comprises a fee determining unit for autonomously determining the respective fee on the basis of the fee information transmitted by the infrared communication device, as well as a booking unit for entering the determined fee in a value account.

2. A system according to claim 1, wherein the infrared communication device is an infrared transmitter for an exclusive information transmission to the mobile communication unit.

3. A system according to claim 1, wherein the infrared communication device comprises a clock and transmits information indicating the respective point of time of transmission with the information identifying itself.

4. A system according to claim 1, wherein the fee is deducted via a mobile value memory.

5. A system according to claim 1, wherein the fee is deducted from an external account.

6. A system according to claim 1, wherein the fee is deducted via a subscriber meter of a telephone account.

7. A system according to claim 1, wherein the mobile infrared communication unit comprises a cryptographic unit.

8. A system according to claim 7, wherein the cryptographic unit comprises a temporarily changing encoder.

9. A system according to claim 1, wherein the infrared communication device comprises a cryptographic unit.

10. A system according to claim 1, wherein the mobile infrared communication unit comprises a memory for storing the information transmitted by the infrared communication device.

11. A system according to claim 1, wherein the mobile infrared communication unit is equipped with an infrared transmitter, and the infrared communication device comprises an infrared receiver and an associated fee charging unit.

12. A system according to claim 1, wherein the mobile infrared communication unit comprises a mobile radio device.

13. A system according to claim 12, wherein the mobile infrared communication unit is in connection with the mobile radio device via an infrared equipment.

14. A system according to claim 12, wherein the mobile infrared communication unit is directly connected in one unit to the mobile radio device.

15. A system according to claim 14, wherein the mobile infrared communication unit shares one housing with the mobile radio device.

16. A system according to claim 12, wherein the mobile radio device is adapted for transmitting information to a central data processing machine.

17. A system according to claim 12, wherein the mobile radio device is a cellular phone electrically connected to a hands-free talking device.

18. A system according to claim 17, wherein the mobile infrared communication unit is connected to the electrical connecting point between the cellular phone and the hands-free talking device.

19. A system according to claim 1, wherein the infrared communication device comprises a mobile radio device.

20. A system according to claim 1, wherein the infrared communication device comprises a solar energy device as a power supply.

21. A system according to claim 1, wherein the infrared communication device is adapted to carry out a self-test, e.g. for checking the power supply, or the functioning of the communication device, respectively.

22. A system for automatically charging fees when predetermined positions are passed, comprising:

a stationarily installed infrared communication device in the form of an infrared transmitter wherein the infrared communication device comprises a clock and transmits information indicating the respective point of time of transmission with the information identifying itself; and at least one mobile infrared communication unit, wherein the infrared communication device is adapted for transmitting information identifying itself exclusively to the mobile communication unit and, thus, its position of installation together with information regarding fees taken from a memory to the mobile infrared communication unit, and the mobile infrared communication unit comprises a fee determining unit for autonomously determining the respective fee on the basis of the fee information transmitted by the infrared communication device, as well as a booking unit for entering the determined fee in a value account.

* * * * *